US006317894B1

(12) United States Patent
Blechman

(10) Patent No.: US 6,317,894 B1
(45) Date of Patent: Nov. 20, 2001

(54) CLOTHING WITH ADJUSTABLE LENGTH PORTION

(76) Inventor: Bernard Blechman, 130 Kingsland Road, London (GB), E2 8DP ( * ) Notice: Subject to any disclaimer, the term of this patent is extended or adjusted under 35 U.S.C. 154(b) by 0 days.

(21) Appl. No.: 09/611,061

(22) Filed: Jul. 6, 2000

(30) Foreign Application Priority Data

Jul. 6, 1999 (GB) ..... 9915820

(51) Int. Cl.[7] ..... A41D 27/10

(52) U.S. Cl. ..... 2/269; 2/115; 2/227; 2/125; 2/126

(58) Field of Search ..... 2/269, 227, 228, 2/115, 113, 114, 125, 126, 108, 94, 95, 85, 80, 83, 272, 93, 69

(56) References Cited

U.S. PATENT DOCUMENTS 222,262 * 12/1879 Felt ..... 2/269
560,683 * 5/1896 Brucker ..... 2/269
2,687,530 * 8/1954 Farnum ..... 2/269
2,692,988 * 11/1954 Rouse ..... 2/269
2,719,981 * 10/1955 Walter ..... 2/269
4,985,936 * 1/1991 Jones ..... 2/269
5,208,920 * 5/1993 Schaefer et al. ..... 2/269
5,299,323 * 4/1994 Schaefer et al. ..... 2/269

* cited by examiner

*Primary Examiner*—Gloria M. Hale
(74) *Attorney, Agent, or Firm*—Darby & Darby

(57) ABSTRACT

The present application describes an item of clothing whose length is to be adjustable, or which has a component part—e.g. legs, sleeves—which is to be adjustable, the clothing item comprising at least one line (4) running from a lower part (2) of the clothing to an upper part (1). The line (4) is pullable by the wearer to lift the lower part relative to the upper part. The clothing item has a pocket (3), at the upper part for receiving at least some of the length of the line after it is pulled so as to shorten the clothing, as well as line gripping means to hold the clothing in its shortened condition.

9 Claims, 3 Drawing Sheets

CLOTHING WITH ADJUSTABLE LENGTH PORTION

The present invention relates to an item of clothing the length of which can be adjusted by the wearer, or the length of a component part—leg, sleeve—of which can be adjusted by the wearer.

It is routine for the sleeves of long sleeved shirts to be rolled up by the wearer and it is also common for long trousers to be rolled up, at least to three quarter length. There have also been some attempts to provide easy and/or stylish systems which allow the wearer of a garment to adjust its length to his or her own personal preference, or according to the weather. For example it is known that trousers can be rolled up and kept rolled up by means of an epaulette on the inside which buttons onto a button on the thigh of the trouser.

A need remains, however, for a system with which the length of an item of clothing, or its component parts, can be varied with relative ease.

Accordingly, the present invention provides an item of clothing whose length is to be adjustable, or which has a component part—e.g. legs, sleeves—which is to be adjustable, the clothing item comprising at least one line running from a lower part of the clothing to an upper part, the line being pullable by the wearer to lift the lower part relative to the upper part, wherein the clothing item has a pocket at the upper part, in which pocket a portion of the line is located to enable the line to be pulled and the pocket being able to receive at least some of the length of the cord after it is pulled to shorten the clothing, and wherein a portion of the line is arranged on the outside of the clothing item below or adjacent the pocket, means to grip the line being provided at the said outside portion.

Preferably, the line runs for a major part of its length, inside of the clothing. The line is preferably fixed at the lower part of the clothing, so the line is pulled at the upper part.

The line can be loose inside the clothing, or can run in a "tunnel" of material, or through loops in a manner analogous to a belt running though belt loops.

It will be understood that the invention can be used in connection with the legs of trousers, or with the sleeves of a shirt, blouse, jacket etc or with both sleeves and legs of a body suit or overalls, or with a dress or other body garment. This list is not exhaustive. With whichever item of clothing the invention is used, it allows the wearer to change the length of the relevant part of the garment with ease, and with the facility to locate the shortening line in a convenient manner. The parts which allow the shortening of the garment can also be presented as items to enhance the style and look of the garment. In other words, the items can be presented in the manner of fashion accessories to increase the desirability and value of the garment, in addition to providing versatility to the use of the garment.

Preferred embodiments of the invention are described below, with reference to the accompanying drawings which show views of a pair of trousers, being an example of one garment incorporating embodiments of the invention.

Figure 1:
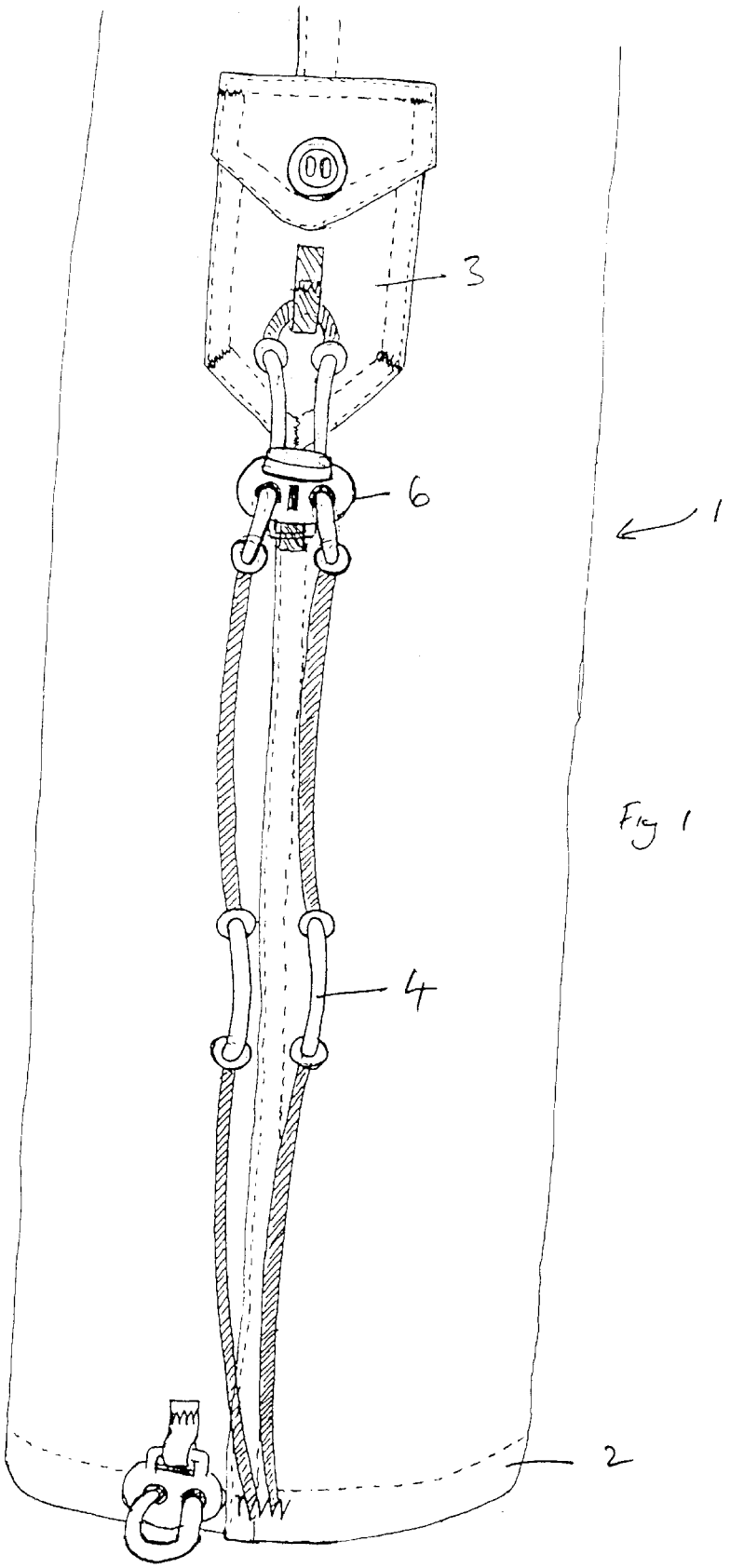
FIG. 1 is a partial view of a pair of trousers, showing the outside of one leg.

In the example of FIG. 1, the idea of the invention is used in connection with a pair of long trousers. The trousers 1 are shown schematically, the view showing the outside of one of the legs of the trousers. The waistband of the trousers is not shown in this figure. Reference numeral 2 indicates the bottom of the trouser leg. The inventive idea will of course be present on the other trouser leg and indeed is conveniently provided on both the inside and outside of each leg.

A pocket 3 is provided somewhere along the length of the leg, in this version at about thigh level. A line 4 runs from the bottom of the trouser leg to the pocket 3, the line running for at least a major portion of its length inside the trouser leg. Those parts of the line 4 which are within the leg or pocket are shown shaded.

In this version, the line is provided by a pair of cords, which may or may not be elasticated. The cord is turned back at the top end to form a double length of cord, with the two ends of the cord being firmly sewn in at the bottom end of the trouser leg. It is possible that a loop of the cord is exposed to the bottom of the trouser leg, this exposure creating a desirable appearance to the garment. Alternatively, as illustrated, a "dummy" loop and cord lock can be incorporated as shown by numeral 5. Of course, the line 4 can be connected to the bottom of the trouser leg in any convenient fashion, according to the wishes of the garment producer.

As is seen in FIG. 1, the cord 4 (or cords) runs outside the trouser leg for part of its length, at or below the knee. This feature both helps to keep the cord at the desired place within the trouser leg, but also adds to the appearance of the garment. The cord may of course be exposed at more than one position along the length of the garment.

In the trousers shown, pocket 3 is an external pocket, though this is not essential. An external patch pocket is appropriate to some items of clothing, for example combat trousers, but a more conventional inset pocket could be chosen on other garments where a different look is desired (see below).

The cord 4 can emerge from the inside of the trouser leg below, above or adjacent the pocket. In the illustrated version, the cord emerges from the inside of the trouser leg below the pocket and then runs into the lower part of the pocket, where it ends. The loop of cord below the pocket is visible to add to the look of the garment.

On the loop of the cord which is near the pocket 3, a cord gripping means or cord lock 6 is provided. Such cord locks are conventional in the garment trade and so the particular construction of the cord lock need not be described in detail here. Standard cord locks work on the principle of an apertured body with a sprung plug slotted therein, the plug also having an aperture which can register with the aperture in the body. The spring between the body and the plug acts to force the plug in a direction out of the body and into a position in which the apertures do not properly register. Cooperating lips between the body and plug prevent the plug from coming fully out of the body. On manufacture of the garment, the cord is threaded through the cord lock. Depression of the plug into the body brings the apertures into registration, so that the cord can easily slip through. However, when the wearer releases the plug, the apertures try and come out of registration, thereby clamping the cord. This clamping action can be increased by having a toothed surface on the inside of the apertures. On some cord locks, a set of double apertures is provided, so a pair of cords runs through and can be locked in the same cord lock.

The cord lock can optionally be attached to the trouser leg, below the pocket 3.

When the wearer of the garment, here a pair of trousers, wishes to adjust the length, the upper end of the cord 4 is pulled from inside the trousers, with the cord lock released, and this action in turn pulls at least part of the length of the cord which initially is inside the trouser leg up and outside the pocket of the trouser leg. When the garment has been shortened to the degree desired by the wearer, the cord lock is released to prevent the lower end of the garment falling down again.

It will be understood that at this stage there will be a length of cord at the pocket end, outside of the garment, this length approximately being equal to the length by which the garment has been shortened. This excess cord 4 is conveniently rolled, folded or otherwise placed into the pocket 3. The location of the excess cord within the pocket avoids a length of cord dangling from the garment, which could be aesthetically displeasing and could even be dangerous if it caught on some nearby structure.

The length by which the garment can be shortened is selectable by the user. For example, with long trousers, the user has the option of turning them into three quarter length or into shorts. To reduce the trousers to a short length, the cord will be pulled to its full degree, part of the length of the cord obviously remaining inside the trouser leg as the length of the leg "bunches" around the user's thigh. Irrespective of how much the garment is shortened, the excess cord length can nonetheless be conveniently accommodated within the pocket 3.

The operation to shorten the legs is obviously reversed to return them to their full length.

It should also be emphasised that while in the above discussion it is suggested that the length of the garment be adjusted by means of a cord lock on the cord, other mechanisms for keeping the cord at the appropriate length, after the garment has been shortened, will be apparent to members of the garment industry. Such mechanisms could be integrated with the design of the pocket 3, for example the flap of the pocket 3 could be designed, in relation to the cord, such that when the pocket is closed it clamps the cord in position, thus avoiding the need for a separate cord lock. Alternatively, the cord or line could run through a relatively narrow tunnel or tube of suitable material, near the pocket, the tunnel or tube providing a sufficient frictional grip to hold the cord until actively pulled by the wearer.

Figure 2:
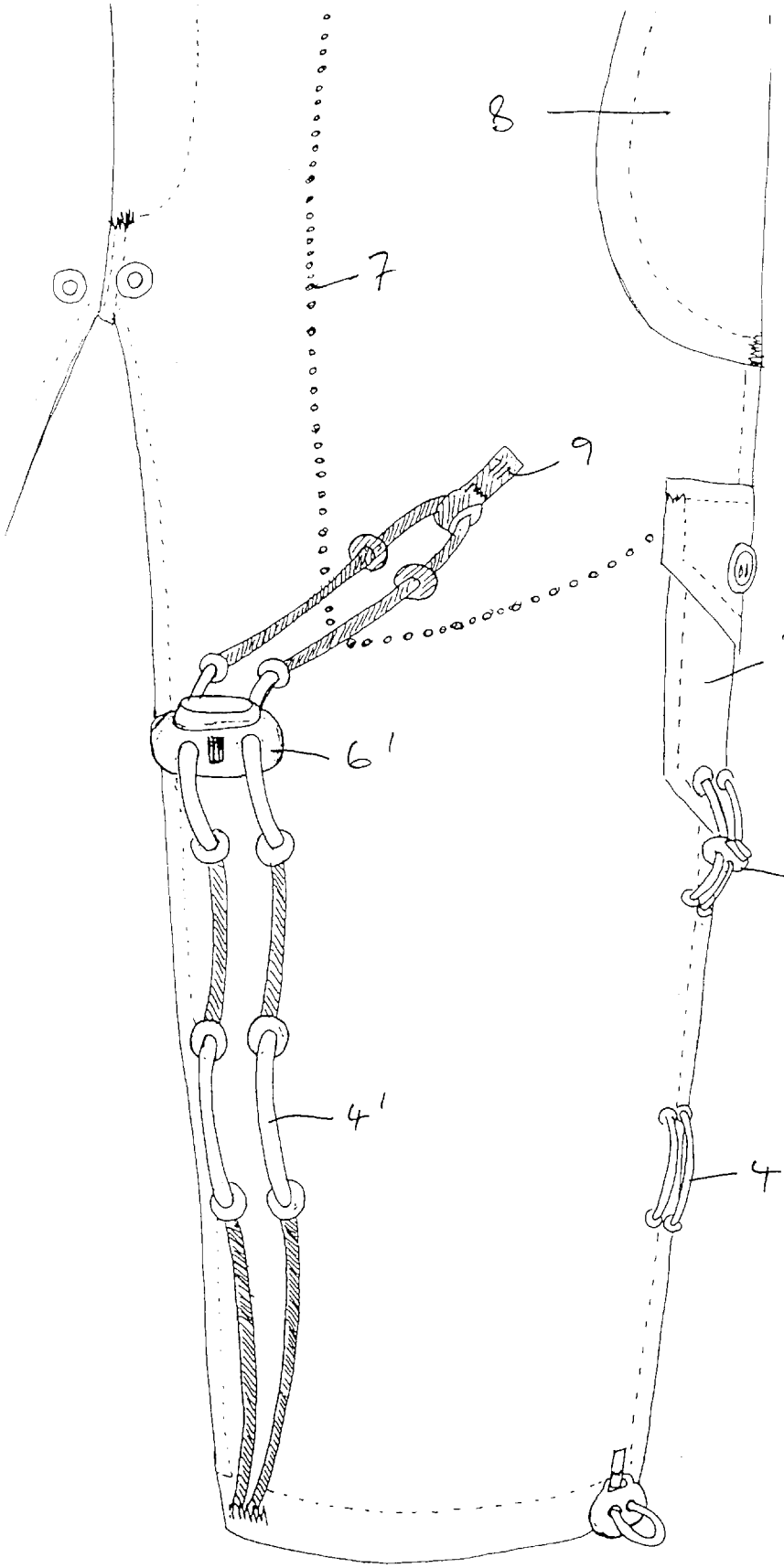
FIG. 2 is a front partial view of a pair of trousers, again showing one leg.

FIG. 2 shows the front view of one leg of a pair of trousers. The outside of the trouser leg is seen to the right of FIG. 2, and it will be understood that the arrangement of cord and pocket on that side is the same as illustrated in FIG. 1. That side of the trouser leg is thus not described in any more detail here. On the inside of the trouser leg of FIG. 2, there is arranged a very similar cord or cords 4', with a cord lock 6' also being provided. The important point about the arrangement of cord 4' on the inside of the trouser leg as seen in FIG. 2 is that the end of the cord is within a hip pocket 7 which is arranged on the inside of the trouser leg, the hip pocket 7 having an optional pocket flap 8.

It will be understood that one difference between the hip pocket 7 and the side pocket 3 is that the pocket 7 is sufficiently large to accommodate the wearer's hand, rather than just one or two fingers which means that the wearer may be able to pull the cord, after release of the cord lock or gripper 6', in such a manner that the excess length of cord is always within the hip pocket and does not have to be pushed back into that pocket after shortening of the trouser leg.

Another difference between the cord and pocket arrangement on the inside of the trouser leg and that of the outside of the trouser leg is that the external part of the cord 4', at which the cord lock is provided, re-enters the trouser leg not through the pocket itself but near the pocket, the cord 4' thus travelling a certain distance inside the trouser leg near the pocket, before passing through standard eyelets into the interior of the pocket. As illustrated, a small tab 9 can be provided to aid pulling of the cord within the pocket.

Figure 3:
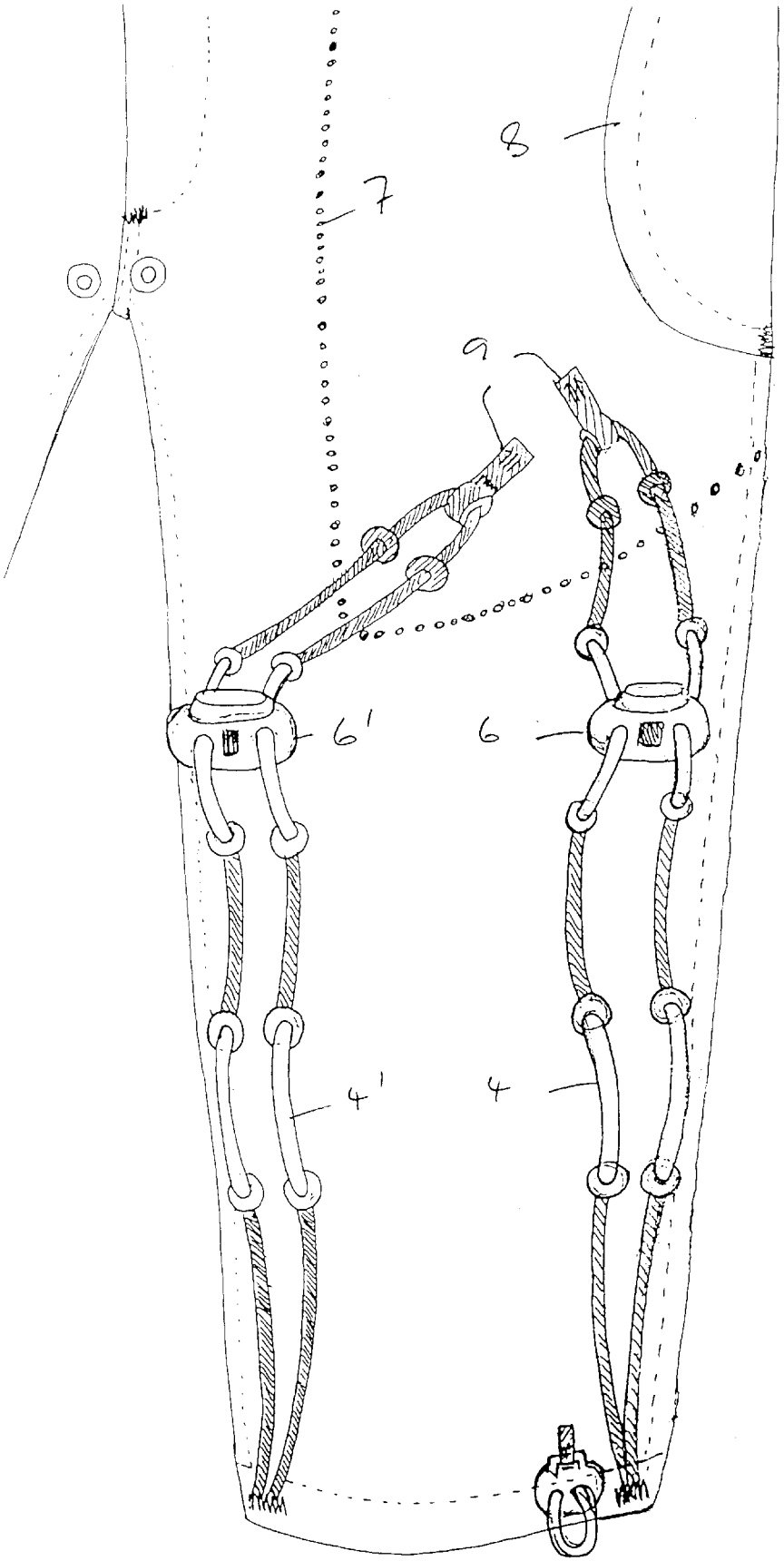
FIG. 3 is a similar view to FIG. 2, showing a variation on the invention as applied to the embodiment of FIG. 2.

The type of trouser illustrated in FIGS. 1 and 2, with an external thigh pocket, is sometimes known as a "cargo" pant. FIG. 3 illustrates a slightly different type of trouser where there is no thigh pocket but still with pullable cords on both the inside and the outside of the trouser leg. In the embodiment of FIG. 3 the inside cord and cord lock arrangement is the same as in FIG. 2, and the outside cord and cord lock arrangement is the same as that on the inside. Thus, two separate cords emerge within the hip pocket 7, these cords thus providing pull-sections within the pocket which can be separately or simultaneously pulled by the wearer to shorten the leg.

While the invention here has been illustrated and described in relation to pair of trousers, it has equal application to other types of garments, for example sleeved garments and dresses. It will be understood that the advantage of the invention is that the length of the garment can be adjusted in any easy manner, without leaving excess lengths of cord hanging loosely from the garment. In particular, in relation to trousers, there is no excess length of cord dangling below the bottom of the shortened trouser leg.

What is claimed is:

1. An item of clothing whose length is adjustable, or which has a component part which is adjustable, the clothing item comprising at least one line running from a lower part of the clothing to an upper part, the line being pullable by the wearer to lift the lower part relative to the upper part, wherein the clothing item has a pocket at the upper part, in which pocket a portion of the line is located to enable the line to be pulled and the pocket being able to receive at least some of a length of the cord after it is pulled to shorten the clothing, and wherein a portion of the line is arranged on an outside of the clothing item below or adjacent the pocket, and with means to grip the line being provided at the said outside portion.

2. An item of clothing according to claim 1, wherein the line runs for a major part of its length inside of the clothing.

3. An item of clothing according to claim 2, wherein the line gripping means is a cord lock for holding the line in the raised position of the clothing.

4. An item of clothing according to claim 2, wherein the line runs loose inside the clothing, runs in a tunnel of material, or runs through loops.

5. An item of clothing according to claim 1, wherein the item is a pair of trousers.

6. An item of clothing according to claim 5, wherein there is a line at the outer side of each trouser leg.

7. An item of clothing according to claim 5, wherein there is a line at the outer side and the inside of each leg.

8. An item of clothing according to claim 5, wherein each line is provided as a double length of line.

9. An item of clothing according to claim 5, wherein the Sine ends within a pocket at the thigh or hip of the trouser leg.

* * * * *